US010743098B2

(12) United States Patent
Spillmann et al.

(10) Patent No.: US 10,743,098 B2
(45) Date of Patent: Aug. 11, 2020

(54) ACOUSTIC HORN FOR AN ACOUSTIC ASSEMBLY

(71) Applicant: HARMAN INTERNATIONAL INDUSTRIES, INCORPORATED, Stamford, CT (US)

(72) Inventors: Jacques Spillmann, Los Angeles, CA (US); Steven Patrick Riemersma, Woodland Hills, CA (US); Mark Thomas Delay, St. Paul, MN (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 16/474,984

(22) PCT Filed: Dec. 29, 2017

(86) PCT No.: PCT/US2017/068936

§ 371 (c)(1),
(2) Date: Jun. 28, 2019

(87) PCT Pub. No.: WO2018/126122

PCT Pub. Date: Jul. 5, 2018

(65) Prior Publication Data

US 2019/0349672 A1 Nov. 14, 2019

Related U.S. Application Data

(60) Provisional application No. 62/440,872, filed on Dec. 30, 2016.

(51) Int. Cl.
*H04R 1/30* (2006.01)
*G10K 11/30* (2006.01)
(Continued)

(52) U.S. Cl.
CPC ..... *H04R 1/30* (2013.01); *G10K 11/30* (2013.01); *H04R 1/403* (2013.01); *G10K 11/343* (2013.01)

(58) Field of Classification Search
CPC ..... H04R 1/30; H04R 1/403; H04R 1/2803; H04R 1/2865; H04R 1/26; H04R 1/02; H04R 27/00; G10K 11/30; G10K 11/343
See application file for complete search history.

(56) References Cited

U.S. PATENT DOCUMENTS 6,081,602 A * 6/2000 Meyer ..... H04R 1/24 381/182
6,343,133 B1 1/2002 Adamson
(Continued)

OTHER PUBLICATIONS

International Search Report of PCT/US2017/068936 dated Mar. 12, 2018, 2 pages.
(Continued)

*Primary Examiner* — Tuan D Nguyen
(74) *Attorney, Agent, or Firm* — Brooks Kushman P.C.

(57) ABSTRACT

An acoustic assembly may include acoustic emitting devices attached to an enclosure. The acoustic assembly may further include an acoustic horn for influencing sound emitted by one or more of the acoustic emitting devices. For example, the acoustic horn may influence a beamwidth of sound emitted by one of the acoustic emitting devices. As a further example, the acoustic horn may influence a first beamwidth of a first acoustic emitting device and a second beamwidth of a second acoustic emitting device in a crossover region between the first acoustic emitting device and the second acoustic emitting device. The acoustic horn may include a waveguide attached to at least one integrator. The at least one integrator may include at least one plug and at least one lens.

20 Claims, 9 Drawing Sheets

(51) Int. Cl.
*H04R 1/40* (2006.01)
*G10K 11/34* (2006.01)

(56) References Cited

U.S. PATENT DOCUMENTS

| | | | | |
|---|---|---|---|---|
| 6,513,622 | B1 | 2/2003 | Gelow et al. | |
| 2003/0188920 | A1 | 10/2003 | Brawley | |
| 2003/0194098 | A1 | 10/2003 | Werner et al. | |
| 2011/0168480 | A1 | 7/2011 | Sterling et al. | |
| 2012/0250897 | A1 | 10/2012 | Michel et al. | |
| 2016/0212523 | A1* | 7/2016 | Spillmann | H04R 1/345 |
| 2017/0013348 | A1* | 1/2017 | Arneson | H04R 3/14 |

OTHER PUBLICATIONS

Written Opinion of PCT/US2017/068936 dated Mar. 12, 2018, 9 pages.

* cited by examiner

ACOUSTIC HORN FOR AN ACOUSTIC ASSEMBLY

CROSS-REFERENCE TO RELATED APPLICATIONS

This application is the U.S. national phase of International Application No. PCT/US2017/068936 filed Dec. 29, 2017, which claims the benefit of U.S. provisional application Ser. No. 62/440,872 filed Dec. 30, 2016, the disclosures of which are hereby incorporated in their entireties by reference herein.

TECHNICAL FIELD

Embodiments herein generally relate to an acoustic horn for an acoustic assembly.

BACKGROUND

An example of a conventional acoustic system includes a first transducer and a second transducer in an enclosure. The first transducer operates over a first frequency range, and the second transducer operates over a second frequency range. While the two frequency ranges are not identical, the first frequency range includes an overlap region with the second frequency range. The overlap region is referred to as a crossover region. In the crossover region, a directivity anomaly occurs. The directivity anomaly is due to a first coverage angle of the first transducer and a second coverage angle of the second transducer in the crossover region. More specifically, the first coverage angle differs from the second coverage angle in the crossover region. The differing coverage angles result in a non-uniform dispersion of sound in a listening area. Because of the non-uniform dispersion, a first person in one location of the listening area may have a drastically different listening experience than a second person in another location of the listening area. Moreover, in the conventional acoustic system, the beamwidths of the first transducer and the second transducers may detract from the listening experience. This may be particularly noticeable in the crossover region.

SUMMARY

In one embodiment, an acoustic assembly includes an enclosure. The enclosure contains at least one acoustic emitting device. Additionally, the acoustic assembly includes an acoustic horn. The acoustic horn is positioned between a removable cover of the acoustic assembly and the at least one acoustic emitting device. Moreover, the acoustic horn includes at least one waveguide, at least one lens, at least one plug, and at least one integrator. The at least one waveguide, the at least one lens, and the at least one plug attach to the at least one integrator.

In another embodiment, an acoustic assembly includes an enclosure. The enclosure includes a plurality of acoustic emitting devices. The acoustic emitting devices are attached to the enclosure. The enclosure further includes an acoustic horn. The acoustic horn is attached to the enclosure. The acoustic horn is configured to improve a beamwidth in a crossover region of the plurality of acoustic emitting devices. The acoustic horn includes a waveguide, a first integrator, and a second integrator. The first integrator and the second integrator are attached to the waveguide. The second integrator is spaced apart from the first integrator.

In another embodiment, an acoustic assembly includes an enclosure. The enclosure includes a plurality of acoustic emitting devices. The acoustic emitting devices are attached to the enclosure. The enclosure further includes an acoustic horn. The acoustic horn is attached to the enclosure. The acoustic horn is configured to improve a beamwidth in a crossover region of the plurality of acoustic emitting devices. The acoustic horn is aligned along a bisecting plane and a mirror plane. The bisecting plane is perpendicular to the mirror plane. The acoustic horn includes a waveguide, a first integrator, and a second integrator. The waveguide is aligned along the mirror plane. The first integrator is aligned along the bisecting plane. The second integrator is aligned along the bisecting plane and spaced apart from the first integrator. The first integrator includes a plug and at least one lens. The plug of the first integrator is aligned along the bisecting plane. The at least one lens of the first integrator is offset from the bisecting plane and the mirror plane. The second integrator includes a plug and at least one lens. The plug of the second integrator is aligned along the bisecting plane and spaced apart from the plug of the first integrator. The at least one lens of the second integrator is offset from the bisecting plane and the mirror plane. Further, the at least one lens of the second integrator is spaced apart from the at least one lens of the first integrator.

In another embodiment, an acoustic assembly includes a plurality of acoustic emitting devices. The acoustic assembly further includes an acoustic horn. The acoustic horn improves a beamwidth in a crossover region of the acoustic emitting devices. A first acoustic emitting device outputs sound over a first frequency range. A second acoustic emitting device outputs sound over a second frequency range. The first frequency range partially overlaps with the second frequency range. Because of that, the first frequency range includes a first crossover region with the second frequency range. The acoustic horn alters the sound from the first acoustic emitting device. For example, the alteration of the sound may occur via a plug and an integrator of the acoustic horn. The plug may be attached to the integrator. The alteration of the sound from the first acoustic emitting device occurs in the first crossover region. Moreover, this alteration of the sound from the first acoustic emitting device changes a first beamwidth in the crossover region from a non-linear-curve for sound coverage angle versus frequency to a substantially linear, decreasing line for sound coverage angle versus frequency. This change improves the first beamwidth. This is because the change creates a more linearized, decreasing line than before for the first beamwidth. This is a desirable change, which is due to the acoustic horn's influence on the sound from the first acoustic emitting device.

Additionally, the acoustic horn alters the sound from the second acoustic emitting device. For example, this alteration may occur via a lens and the integrator. The lens may be attached to the integrator. The alteration of the sound from the second acoustic emitting device occurs in the first crossover region. Moreover, this alteration changes a second beamwidth in the crossover region from a non-linear curve for sound coverage angle versus frequency to a substantially linear, decreasing line for sound coverage angle versus frequency. Similarly, this change improves the second beamwidth. This is because the change creates a more linearized, decreasing line than before for the second beamwidth. This is a desirable change, which is due to the acoustic horn's influence on the sound from the second acoustic emitting device. The substantially linear, decreasing line of the improved first beamwidth may be parallel to the substantially linear, decreasing line of the improved second beamwidth.

Further, the acoustic horn may alter and improve one or more additional beamwidths, which may be in one or more additional crossover regions. For example, the acoustic horn may alter and improve a third beamwidth and a four beamwidth in a second crossover region between the second acoustic emitting device and a third acoustic emitting device. For example, this alteration may occur via the lens and the integrator, as well as a waveguide. The waveguide may be attached to the integrator. Similarly, the alteration and improvement of the third and fourth beamwidths may change from non-linear curves to yielding substantially linear, decreasing lines for sound coverage angle versus frequency. The changes may create more linearized, decreasing lines than before—i.e., without the acoustic horn. Moreover, the substantially linear, decreasing line of the improved third beamwidth may be parallel to the substantially linear, decreasing line of the improved fourth beamwidth.

In another embodiment, an acoustic assembly includes an enclosure. A first transducer is attached to the enclosure. The first transducer may emit sound along a first path over a first frequency range. A second transducer is attached to the enclosure. The second transducer may emit sound along a second path over a second frequency range. An acoustic horn is attached to the enclosure. The acoustic horn may be positioned to at least partially extend into the first path and the second path. The acoustic horn may adjust at least one beamwidth in a crossover region of the first frequency range and the second frequency range. For example, the acoustic horn may adjust the beamwidth of the first transducer in the crossover region of the first frequency range and the second frequency range. As another example, the acoustic horn may adjust the beamwidth of the second transducer in the crossover region of the first frequency range and the second frequency range. The acoustic horn includes a waveguide. The waveguide may be positioned to at least partially extend into the first path. The acoustic horn further includes an integrator. The integrator is attached to the waveguide. The integrator may be positioned to at least partially extend into the second path.

In another embodiment, an acoustic assembly includes an enclosure. The acoustic assembly further includes a plurality of transducers that are supported by the enclosure. The plurality of transducers includes a first transducer and a second transducer. The first transducer may emit sound along a first path over a first frequency range. The second transducer may emit sound along a second path over a second frequency range. The acoustic assembly further includes an acoustic horn attached to the enclosure. The acoustic horn may be positioned to at least partially extend into the first path of the first transducer and the second path of the second transducer. The acoustic horn may adjust at least one beamwidth in a crossover region of the first frequency range and the second frequency range. The acoustic horn is aligned along a first plane that bisects the enclosure and a second plane that is arranged perpendicular to the first plane. The acoustic horn includes a waveguide aligned along the second plane. The acoustic horn further includes a first integrator aligned along the first plane. The acoustic horn further includes a second integrator aligned along the first plane and spaced from the first integrator.

In another embodiment, an acoustic assembly includes an enclosure. The acoustic assembly further includes a first plurality of transducers attached to the enclosure. The first plurality of transducers may emit sound over a first frequency range. The acoustic assembly further includes a second plurality of transducers attached to the enclosure. The second plurality of transducers may emit sound over a second frequency range. The acoustic assembly further includes a third plurality of transducers attached to the enclosure. The third plurality of transducers may emit sound over a third frequency range. The acoustic assembly further includes an acoustic horn positioned on the enclosure. The acoustic horn may adjust at least one beamwidth in a crossover region of the first frequency range and the second frequency range. The acoustic horn may adjust at least one beamwidth in a crossover region of the second frequency range and the third frequency range. The acoustic horn includes a waveguide, a first integrator attached to the waveguide, and a second integrator attached to the waveguide and spaced from the first integrator.

As such, the inclusion of the acoustic horn is desirable because of its influence on sound from the acoustic emitting devices in the acoustic assembly. The acoustic horn in one or more embodiments may be used to improve a beamwidth of the acoustic assembly. This may be by adjusting one or more beamwidths in a crossover region. This may be by altering the path(s) of sound emitted by one or more of the acoustic emitting devices. The acoustic horn may therefore correct the path(s) to achieve a desired beamwidth, such as in a crossover region.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
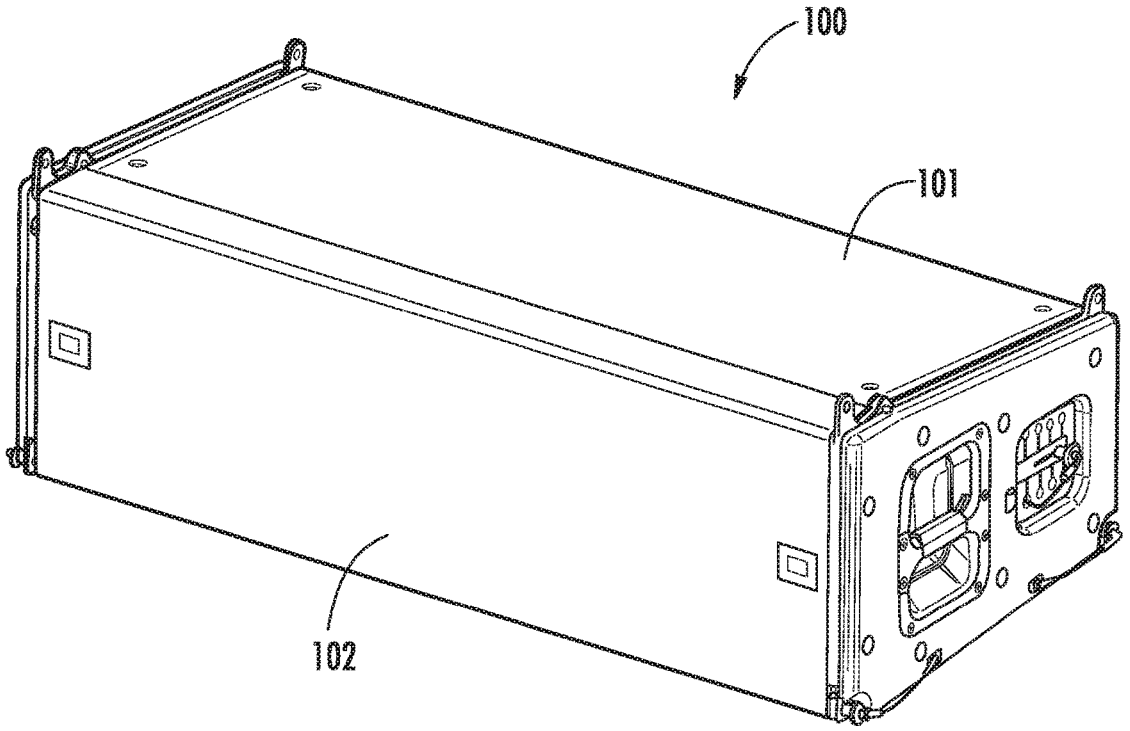
FIG. 1 illustrates a perspective view of an acoustic assembly according to one or more embodiments.

FIG. 1 illustrates a perspective view of an acoustic assembly 100, which is in accordance with one or more embodiments of the present invention. The acoustic assembly 100 includes an enclosure 101. The enclosure 101 may include a modular construction, an integral construction, such as from a molding process, or a combination thereof. Furthermore, the enclosure 101 may include an exterior shape, which may appear cubic, rectangular, trapezoidal, spherical, conical, cylindrical, ellipsoidal, triangular, pentagonal, hexagonal, pyramidal, or another multi-sided three-dimensional shape.

Further in FIG. 1, a cover 102 may removably attach to the enclosure 101. The cover 102 may be removably attached to the enclosure 101 by fasteners, adhesives, and/or other ways known in the art. Moreover, the cover 102 may be shaped similarly or identical to one or more sides of the enclosure 101. Furthermore, the cover 102 may be a solid panel or an acoustically transparent grille. Using the solid panel as the cover 102 may be desirable for use during set-up, tear-down, transportation, and/or storage of the acoustic assembly 100. When the solid panel is attached to the enclosure 101, sensitive and/or critical components, such as a loudspeaker diaphragm, that would otherwise be exposed to the surroundings may be completely covered and protected. The protection from the surroundings may be due to the solid panel's robust design, which is able to withstand forces commonly experienced with set-up, tear-down, transportation, and/or storage of the acoustic assembly 100. Under such forces, the solid panel will not fail. Conversely without the solid panel, such forces could impact the sensitive and/or critical components directly, which could cause those components to fail. Alternatively, to the solid panel, using the acoustically transparent grille as the cover 102 may be desirable during operation of the acoustic assembly 100. During operation, the acoustically transparent grille does not interfere with sound waves produced from the acoustic assembly 100. As another alternative, the cover 102 may be removed completely before operating the acoustic assembly 100.

The acoustic assembly 100 may be removably attached to one or more additional acoustic assemblies. For example, one or more additional acoustic assemblies may be removably attached to the acoustic assembly 100 to create a line-array. The line-array may be hung, such as to a rafter or scaffolding, above a ground floor.

Figure 2:
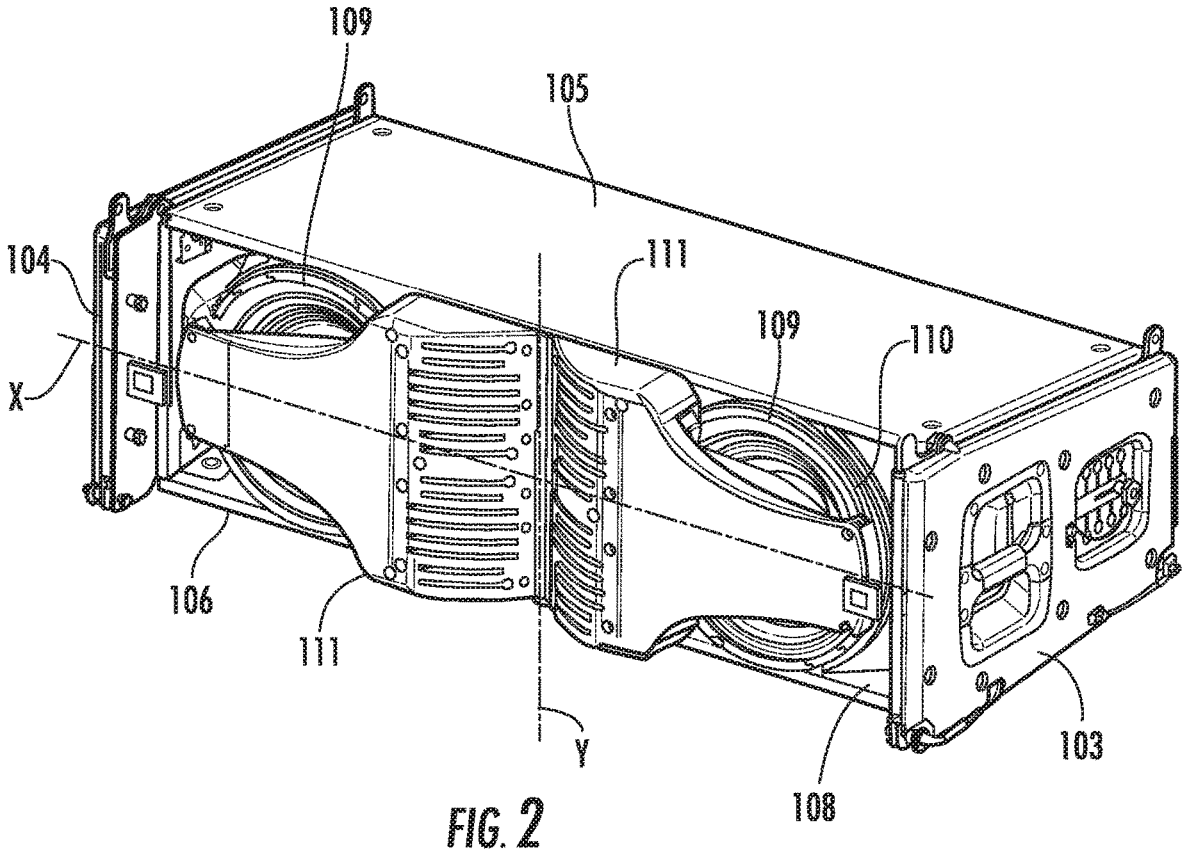
FIG. 2 illustrates a perspective view of an enclosure of the acoustic assembly of FIG. 1.

In FIG. 2, the enclosure 101 of the acoustic assembly 100 is illustrated without the cover 102. As an example of removal, the cover 102 may have been detached, such as by unscrewing threaded fasteners, from a first side 103 and a second side 104 of the enclosure 101. After detaching, the cover 102 may have been removed from the enclosure 101.

In the enclosure 101, the first side 103 may be laterally spaced from the second side 104 along an X axis. The first side 103 may generally be parallel to the second side 104, and the first side 103 may generally mirror the shape of the second side 104. Further on shape, the first side 103 and the second side 104 may include tapered portions, as shown in the illustrated embodiment. Additionally, the first side 103 and the second side 104 may attach to a top side 105, a bottom side 106, and a back side 107. The top side 105 may be laterally spaced from the bottom side 106 along a Y axis. The Y axis may be oriented 90 degrees to the X axis. Additionally, the back side 107 may attach to the top side 105 and the bottom side 106. The first side 103, the second side 104, the top side 105, the bottom side 106, and the back side 107 may define a cavity 108 for receiving at least one acoustic emitting device 109, such as a loudspeaker or a compression driver. To receive the at least one acoustic emitting device 109, the cavity may include a frame 110. The frame 110 may attach to the first side 103, the second side 104, the top side 105, the bottom side 106, and/or the back side 107. Alternatively, the frame 110 may be integrally formed with the first side 103, the second side 104, the top side 105, the bottom side 106, and/or the back side 107.

Additionally, the acoustic assembly 100 may include at least one acoustic horn 111. The at least one acoustic horn 111 at least partially covers the at least one acoustic emitting device 109. The at least one acoustic horn 111 may improve one or more acoustical parameters of the acoustic assembly. For example, the at least one acoustic horn 111 may be designed to achieve a desired directivity of the acoustic assembly 100. As another example, the acoustic horn 111 may be designed to achieve a smooth, uninterrupted transition across frequency bands, which at least range from a low frequency (20 Hz) to a high frequency (20 KHz). Furthermore, the at least one acoustic horn 111 may attach to the first side 103, the second side 104, the top side 105, the bottom side 106, the back side 107, the at least one acoustic emitting device 109, and/or the frame 110. The attachments between the first side 103, the second side 104, the top side 105, the bottom side 106, the back side 107, the at least one acoustic emitting device 109, the frame 110, and/or the acoustic horn 111 may be serviceable or non-serviceable and may occur by fasteners, adhesive, and/or other ways known in the art.

Figure 3:
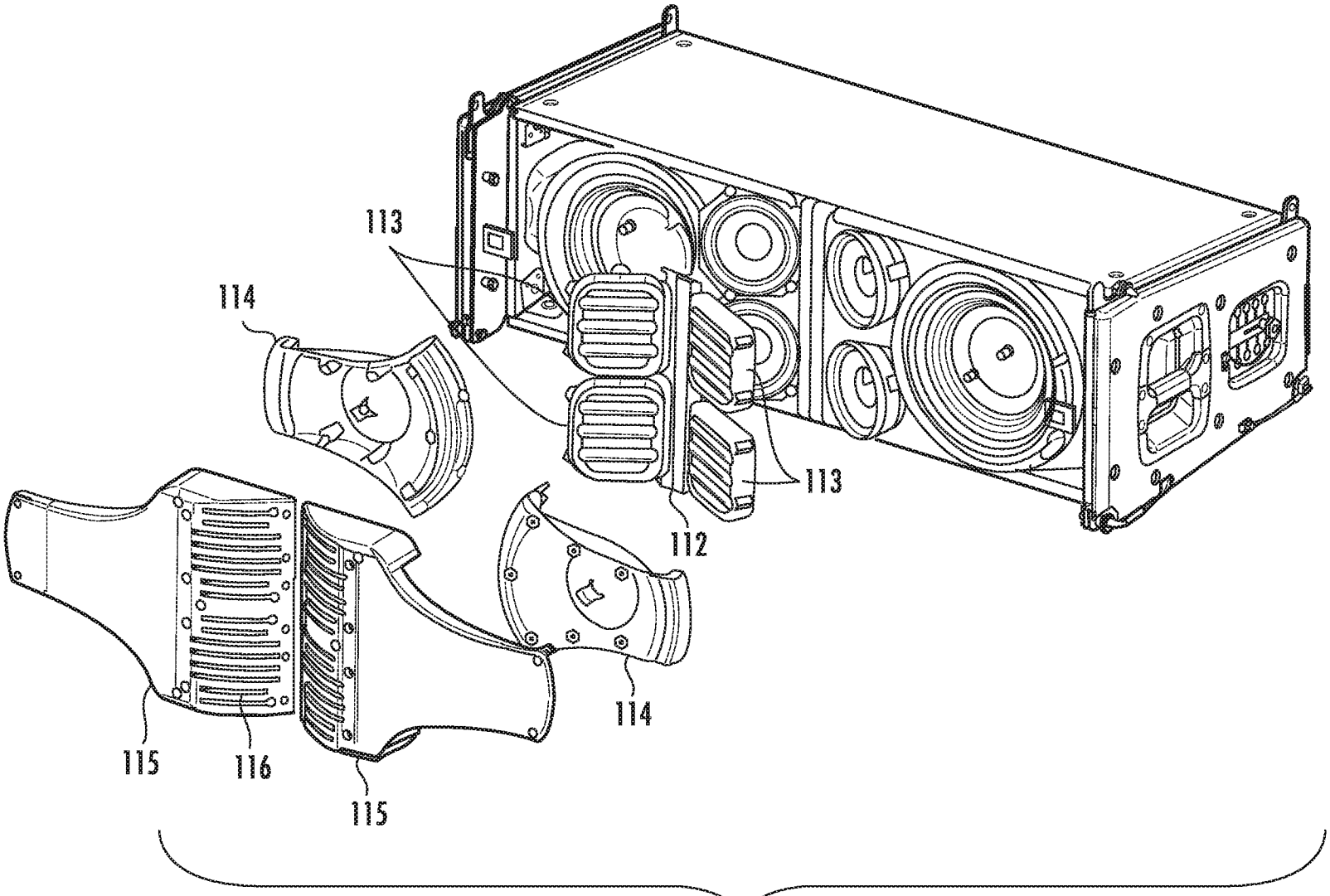
FIG. 3 illustrates an exploded view of an acoustic horn of the acoustic assembly from FIG. 1.

FIG. 3 illustrates an exploded view of the acoustic horn 111 for the acoustic assembly 100. The acoustic assembly 100 may include at least one waveguide 112, at least one lens 113, at least one plug 114, and/or at least one integrator 115. The at least one waveguide 112, the at least one lens 113, and the at least one plug 114 may attach to the at least one integrator 115. The attachments may be permanent or non-permanent and may occur by fasteners, adhesive, and or/or other ways known in the art. Additionally, as part of the attachments, a vibration absorbing layer (not shown) may be placed between the at least one integrator 115 and the at least one waveguide 112, the at least one lens 113, and/or the at least one plug 114. Alternatively, the at least one waveguide 112, the at least one lens 113, and/or the at least one plug 114 may be integrally formed with the at least one integrator 115.

As an example of the acoustic horn 111 in the acoustic assembly 100, when the at least one acoustic emitting device 109 in the acoustic assembly 100 includes at least one high-frequency compression driver, the at least one waveguide 112 may be positioned in front of an output opening of the at least one high-frequency compression driver. Positioning the at least one waveguide 112 in that manner allows the at least one waveguide 112 to receive and influence a sound wave—such as directivity—from the at least one high-frequency compression driver. In addition to positioning, the at least one waveguide 112 may attach to the at least one high-frequency compression driver.

As a further example, when the at least one acoustic emitting device 109 in the acoustic assembly 100 includes at least one mid-frequency loudspeaker, the at least one lens 113 may be positioned in front of an output side of the at least one mid-frequency loudspeaker. Positioning the at least one lens 113 in that manner allows the at least one lens 113 to receive and influence a sound wave—such as directivity—from the at least one mid-frequency loudspeaker. In addition to positioning, the at least one lens 113 may attach to the at least one mid-frequency loudspeaker.

As another example, when the at least one acoustic emitting device 109 in the acoustic assembly 100 includes at least one low-frequency loudspeaker, the at least one plug 114 may be positioned in front of an output side of the at least one low-frequency loudspeaker. Positioning the at least one plug 114 in that manner allows the at least one plug 114 to receive and influence a sound wave—such as directivity—from the at least one low-frequency loudspeaker. Furthermore, one or more of the at least one waveguide 112, the at least one lens 113, the at least one plug 114, and the at least one integrator 115 may include at least one through-hole aperture 116, such as a slotted opening, for directing sound waves there-through.

Figure 4:
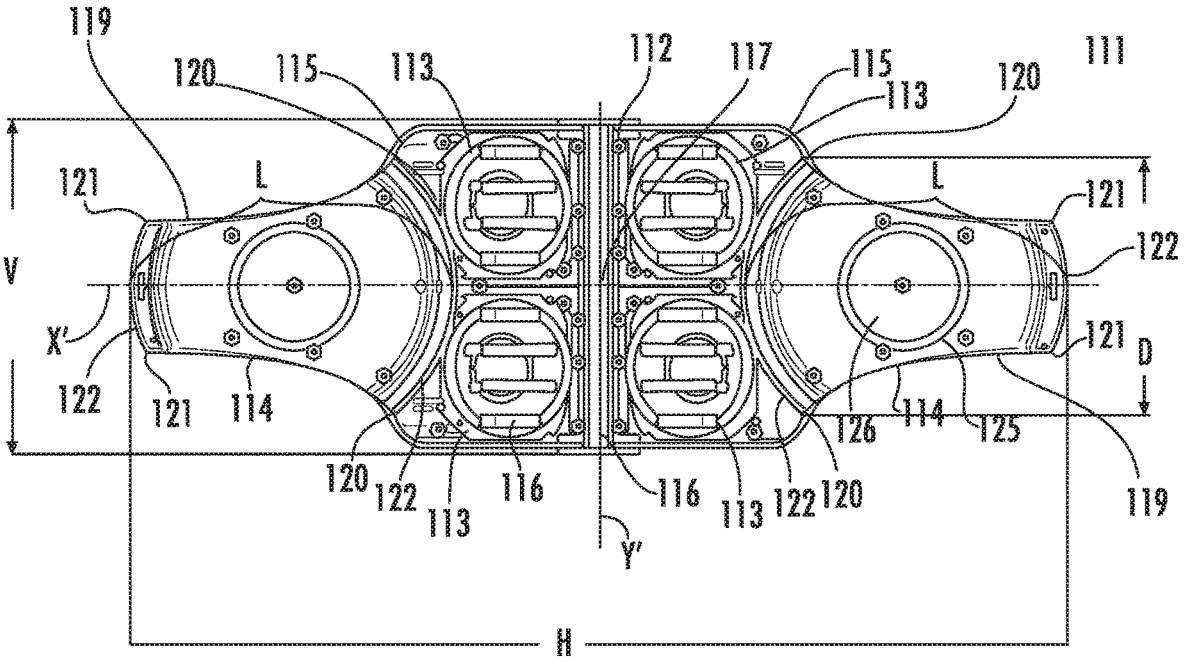
FIGS. 4-5 illustrate rear views of the acoustic horn of FIG. 3.
Figure 5:
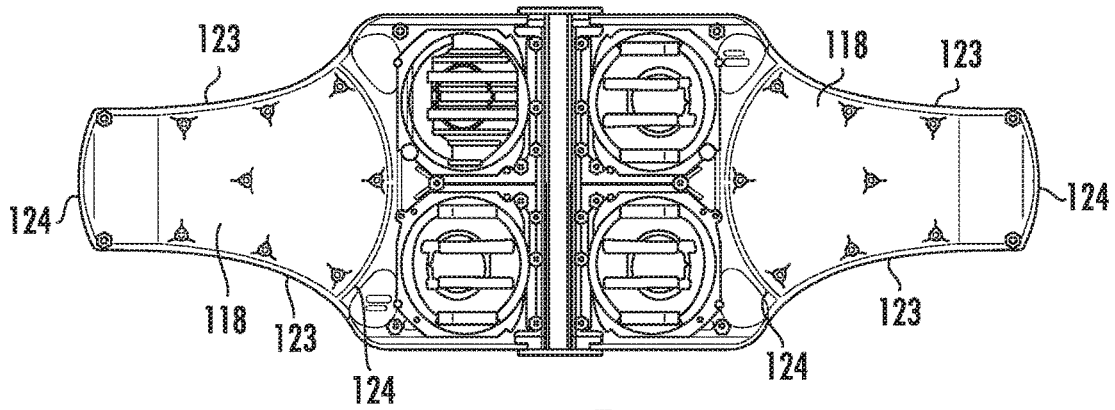
Figure 6:
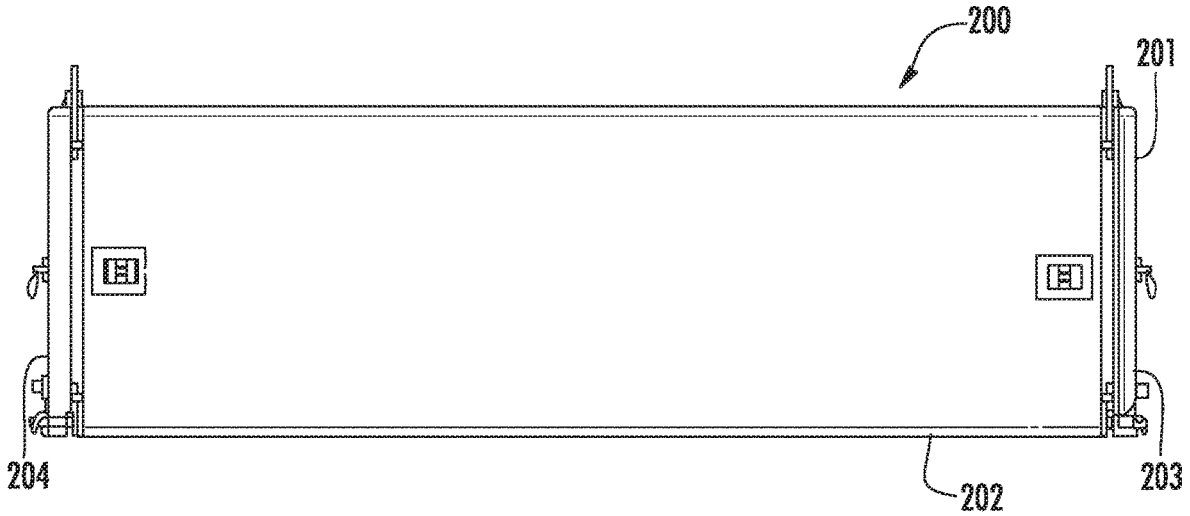
FIG. 6-10 illustrate front views of an acoustic assembly according to one or more embodiments.

FIG. 4 illustrates an example of the acoustic horn 111 for the acoustic assembly 100. In the example, the acoustic horn 111 aligns along an X' plane containing the X axis. Additionally, the acoustic horn 111 aligns along a Y' plane containing the Y axis. Like the X and Y axes, the X' plane is oriented 90 degrees to the Y' plane. The acoustic horn 111 includes a center point 117 that is positioned along a line at the intersection of the X' plane and the Y' plane. The center point 117 may correspond to the intersection of the X axis and the Y axis. Based on the design of the acoustic horn 111, the acoustic horn 111 may include a desired directivity in the X' plane. Additionally, based on the design of the acoustic horn 111, the acoustic horn 111 may include a desired directivity in the Y' plane.

Along the X' plane, the acoustic horn 111 includes a horizontal length H, which runs in the direction of the X axis. And along the Y' plane, the acoustic horn includes a vertical length V, which runs in the direction of the Y axis. The horizontal length H is greater than the vertical length V. Furthermore, the Y' plane may act as a first mirror such that a first portion of the acoustic horn 111 mirrors a second portion of the acoustic horn 111. Additionally, the X' plane may act as a second mirror such that a third portion of the acoustic horn 111 mirrors a fourth portion of the acoustic horn 111.

In the example of FIG. 4, the acoustic horn 111 includes one waveguide 112. The one waveguide 112 extends along the Y' plane. The one waveguide 112 may do so in the direction of the Y axis. The one waveguide 112 includes at least one through-hole aperture 116. In addition to the one waveguide 112, the acoustic horn includes four lenses 113. The four lenses 113 may be evenly distributed around the X' plane and Y' plane. Additionally, the four lenses 113 may be adjacent to the one waveguide 112. Each of the four lenses 113 includes at least one through-hole aperture 116. In addition to the four lenses 113, the acoustic horn 111 includes two plugs 114. The two plugs 114 are laterally spaced from one another along the X' plane. The lateral spacing of the two plugs 114 may be done in the direction of the X axis. In addition to the two plugs 114, the acoustic horn 111 includes two integrators 115. The two integrators 115 may be adjacent to the one waveguide 112. Each of the two integrators 115 includes at least one through-hole aperture 116, which may be in fluid communication with one or more of the through-hole apertures 116 of the lenses 113. The one waveguide 112, the four lenses 113, and the two plugs 114 may attach to the two integrators 115. When attached, the two plugs 114 and the two integrators 115 form two sealed chambers 118. The two sealed chambers 118 may be hollow or filled with a material. The two chambers 118 may act as resonators when used in the acoustic assembly 100.

The two plugs 114 include overall horizontal lengths L along the X' plane, which run in the direction of the X axis. Additionally, the two plugs include overall vertical lengths D, which are in directions parallel to the Y axis on the Y' plane. The overall horizontal lengths L are greater than the vertical lengths D. The perimeters of the two plugs 114 are non-circular and include arcuate tapered segments 119. On the two plugs 114, with reference to the Y axis on the Y' plane, the arcuate tapered segments 119 begin at starting points 120 furthest from the X axis on the X' plane. And, again with reference to the Y axis on the Y' plane, the arcuate tapered segments 119 taper to end points 121 that are closer to the X axis on the X' plane than their respective starting points 120. From the arcuate tapered segments 119, radial segments 122 may complete the perimeters of the two plugs 114. Like the two plugs 114, the two integrators 115 include arcuate tapered segments 123 and radial segments 124, which correspond to the arcuate tapered segments 119 and the radial segments of the two plugs 114. The surfaces of the two plugs 114 may be smooth. Alternatively, the surfaces of the two plugs 114 may include one or more protrusions 125 and/or indentations 126.

FIGS. 6 through 11 illustrate an acoustic assembly 200, which is in accordance with one or more embodiments of the present invention. The acoustic assembly 200 includes an enclosure 201. A cover 202 removably attaches to the enclosure 201. In particular, the cover 202 removably attaches to a first side 203 and a second side 204 of the enclosure 201. Additionally, the first side 203 and the second side 204 of the enclosure 201 attach to a top side 205, a bottom side 206, and a back side 207. The first side 203, the second side 204, the top side 205, the bottom side 206, and the back side 207 define a cavity 208 for receiving a first low-frequency loudspeaker 209, a second low-frequency loudspeaker 210, a first mid-frequency loudspeaker 211, a second mid-frequency loudspeaker 212, a third mid-frequency loudspeaker 213, a fourth mid-frequency loudspeaker 214, a first high-frequency compression driver 215, a second high-frequency compression driver 216, and a third high-frequency compression driver 217. To receive the two low-frequency loudspeakers 209, 210, the four mid-frequency loudspeakers 211, 212, 213, 214, and the three high-frequency compression drivers 215, 216, 217, the cavity includes a frame 218. The frame 218 at least attaches to the bottom side 206.

In the acoustic assembly 200, the first and the second low-frequency loudspeakers 209, 210 are in the cavity 208 of the enclosure 201. The first and the second low-frequency loudspeakers 209, 210 are attached to the frame 218. Moreover, the first and the second low-frequency loudspeakers 209, 210 align along a first plane 219. The first plane 219 bisects the first low-frequency loudspeaker 209. Additionally, the first plane 219 bisects the second low-frequency loudspeaker 210. Along the first plane 219, the first low-frequency loudspeaker 209 is laterally spaced from the second low-frequency loudspeaker 210.

Further in the acoustic assembly 200, the first, the second, and the third high-frequency compression drivers 215, 216, 217 are aligned along a second plane 220. The first, the second, and the third high-frequency compression drivers 215, 216, 217 are attached to the frame 218. The second plane 220 is oriented 90 degrees to the first plane 219. The second plane 220 bisects the first high-frequency compression driver 215, as well as the second high-frequency compression driver 216 and the third high-frequency compression driver 217. Unlike the first high-frequency compression driver 215 and third high-frequency compression driver 217, the second high-frequency compression driver 216 is also aligned along the first plane 219. Because of that, the first plane 219 also bisects the second compression driver 216.

Further in the acoustic assembly 200, the first, the second, the third, and the fourth mid-frequency loudspeakers 211, 212, 213, 214 are distributed around the first plane 219 and the second plane 220. Because the first plane 219 and the second plane 220 intersect, the first plane 219 and the second plane 220 form four quadrants: I, II, III, and IV. In quadrant I, the first mid-frequency loudspeaker 211 is positioned and attached to the frame 218. In quadrant II, the third mid-frequency loudspeaker 213 is positioned and attached to the frame 218. In quadrant III, the fourth mid-frequency loudspeaker 214 is positioned and attached to the frame 218. In quadrant IV, the second mid-frequency loudspeaker 212 is positioned and attached to the frame 218.

The first low-frequency loudspeaker 209 includes a rear face 221 that faces the back side 207. Additionally, the second low-frequency loudspeaker 210 includes a rear face 222 that also faces the back side 207. Opposite the rear face 221, the first low-frequency loudspeaker 209 includes a front output side 223. The front output side 223 of the first low-frequency loudspeaker 209 is at least defined by a diaphragm 224. When the cover 202 is attached, the front output side 223 faces the cover 202. Additionally, opposite the rear face 222, the second low-frequency loudspeaker 210 includes a front output side 225. The front output side 225 of the second low-frequency loudspeaker 210 is at least defined by a diaphragm 226. Like the first low-frequency loudspeaker 209, the front output side 225 of the second low-frequency loudspeaker 210 also faces the cover 202, when the cover 202 is attached.

The first, the second, and the third high-frequency compression drivers 215, 216, 217 include a first output opening 227, a second output opening 228, and a third output opening 229, respectively. When the cover 202 is attached, the first output opening 227, the second output opening 228, and the third output opening 229 face the cover 202.

Similar to the first and the second low-frequency loudspeaker 209, 210, the first, the second, the third, and the fourth mid-frequency loudspeakers 211, 212, 213, 214 include front output sides 230, 231, 232, 233, respectively. When the cover 202 is attached, the front output sides 230, 231, 232, 233 of the four mid-frequency loudspeakers 211, 212, 213, 214 generally face the cover 202. Unlike the first and the second low-frequency loudspeakers 209, 210, though, the front output sides 230, 231, 232, 233 of the four mid-frequency loudspeakers are angled toward the second plane 220.

Furthermore, the acoustic assembly 200 includes an acoustic horn 234. The acoustic horn includes a waveguide 235. The waveguide 235 is aligned along the second plane 220. The second plane 220 bisects the waveguide 235. The waveguide 235 is positioned in front of the first output opening 227, the second output opening 228, and the third output opening 229 of the first, the second, and the third high-frequency compression drivers 215, 216, 217. Because of the positioning, the waveguide 235 receives and influences sound waves from the first, the second, and the third high-frequency compression drivers 215, 216, 217. When the cover 202 is attached, the waveguide 235 is between the cover 202 and the first, the second, and the third high-frequency compression drivers 215, 216, 217.

In addition to the waveguide 235, the acoustic horn 234 includes a first lens 236, a second lens 237, a third lens 238, and a fourth lens 239. With respect to the first mid-frequency loudspeaker 211, the first lens 236 is positioned in front of the front output side 230. With respect to the second mid-frequency loudspeaker 212, the second lens 237 is positioned in front of the front output side 231. With respect to the third mid-frequency loudspeaker 213, the third lens 238 is positioned in front of the front output side 232. And with respect to the fourth mid-frequency loudspeaker 214, the fourth lens 239 is positioned in front of the front output side 233. Because of the positioning, the first, the second, the third, and the fourth lenses 236, 237, 238, 239 receive and influence sound waves from the first, the second, the third, and the fourth mid-frequency loudspeakers 211, 212, 213, 214. When the cover 202 is attached, the first, the second, the third, and the fourth lenses 236, 237, 238, 239 are positioned between the cover 202 and the first, the second, the third, and the fourth mid-frequency loudspeakers 211, 212, 213, 214.

In addition, the acoustic horn 234 includes a first plug 240 and a second plug 241. With respect to the first low-frequency loudspeaker 209, the first plug 240 is positioned in front of the front output side 223. With respect to the second low-frequency loudspeaker 210, the second plug 241 is positioned in front of the front output side 225. Because of the positioning, the first and the second plugs 240, 241 receive and influence sound waves from the first and the second low-frequency loudspeakers 209, 210. When the cover 202 is attached, the first and the second plugs 240, 241 are positioned between the cover 202 and the first and the second low-frequency loudspeakers 209, 210.

Further, the acoustic horn 234 includes a first integrator 242 and a second integrator 243. The waveguide 235, the first lens 236, the second lens 237, and the first plug 240 are attached to the first integrator 242. The waveguide 235, the third lens 238, and the fourth lens 239, and the second plug 241 are attached to the second integrator 243. The first integrator 242 at least covers the first mid-frequency loudspeaker 211, the second mid-frequency loudspeaker 212, and the first plug 240. The second integrator 243 at least covers the third mid-frequency loudspeaker 213, the fourth mid-frequency loudspeaker 214, and the second plug 241. When the cover 202 is attached, the cover 202 covers the first integrator 242 and the second integrator 243.

The first plug 240 may have a convex side 244, and the second plug 241 may have a convex side 245. With respect to the first plug 240, the convex side 244 may face the diaphragm 224 of the first low-frequency loudspeaker 209. The diaphragm 224 may have a conical shape, which may be a frustoconical shape. The first low-frequency loudspeaker 209 may have a cone volume 246 defined by the diaphragm 224. The convex side 244 of the first plug 240 may be positioned into a portion of the cone volume 246. During operation of the first low-frequency loudspeaker 209, the diaphragm 224, however, does not contact the first plug 240. Therefore, the convex side 244 of the first plug is spaced from the diaphragm 224 of the first low-frequency loudspeaker 209, such that the diaphragm 224 does not contact the first plug 240 during operation of the first low-frequency loudspeaker 209. Furthermore, during operation, sound waves from the first low-frequency loudspeaker 209 may travel around the first plug 240.

With respect to the second plug 241, the convex side 245 may face the diaphragm 226 of the second low-frequency loudspeaker 210. The diaphragm 226 may have a conical shape, which may be a frustoconical shape. The second low-frequency loudspeaker 210 may have a cone volume 247 defined by the diaphragm 226. The cone volume 247 of the second low-frequency loudspeaker 210 may equal the cone volume 246 of the first low-frequency loudspeaker 209. The convex side 245 of the second plug 241 may be positioned into a portion of the cone volume 247 of the second low-frequency loudspeaker 210. Like the first low-frequency loudspeaker 209, during operation of the second low-frequency loudspeaker 210, the diaphragm 226 does not contact the second plug 241, because the convex side 245 is spaced from the diaphragm 226. Furthermore, during operation, sound waves from the second low-frequency loudspeaker 210 may travel around the second plug 241.

Figure 7:
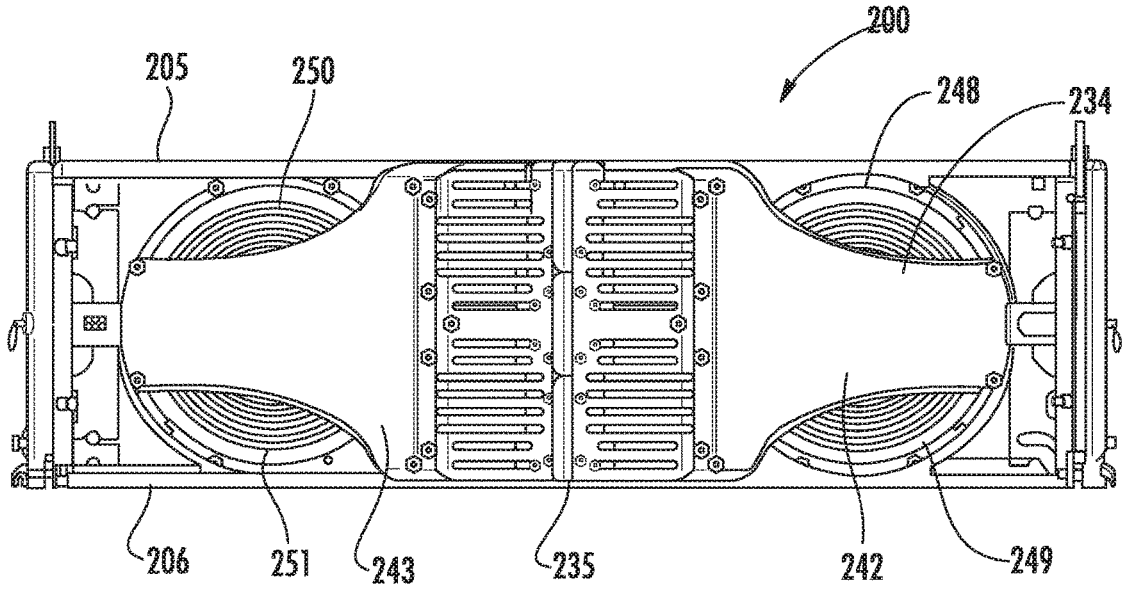
Figure 8:
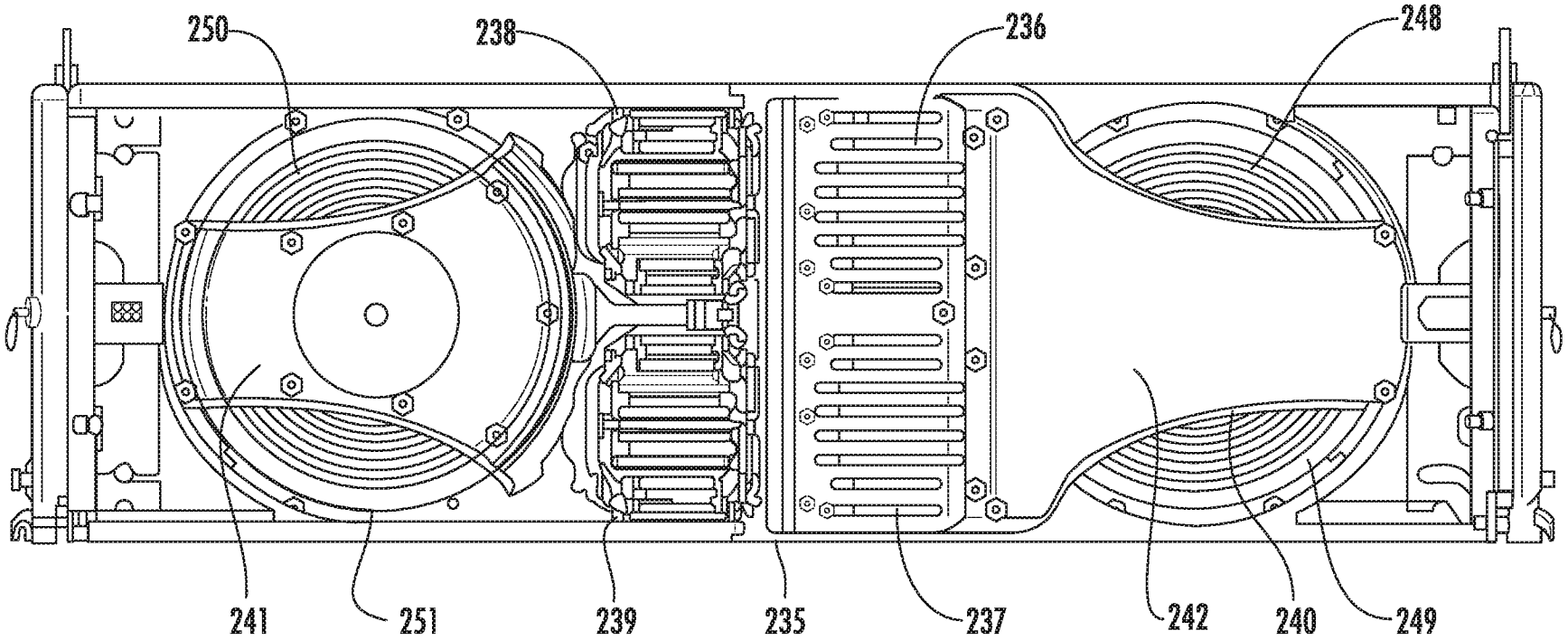
Figure 9:
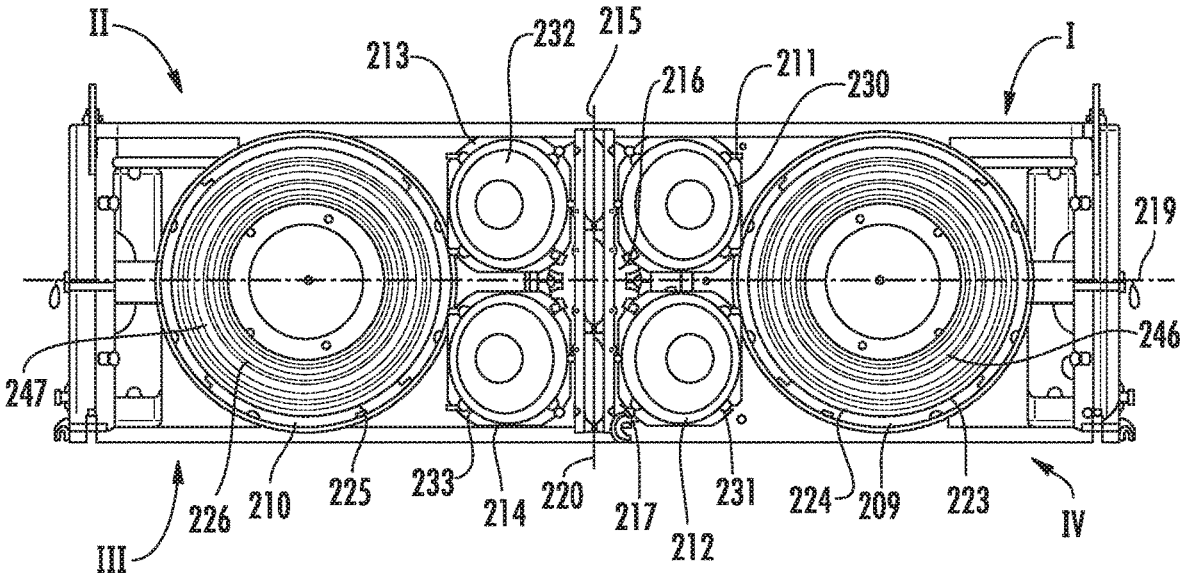
Figure 10:
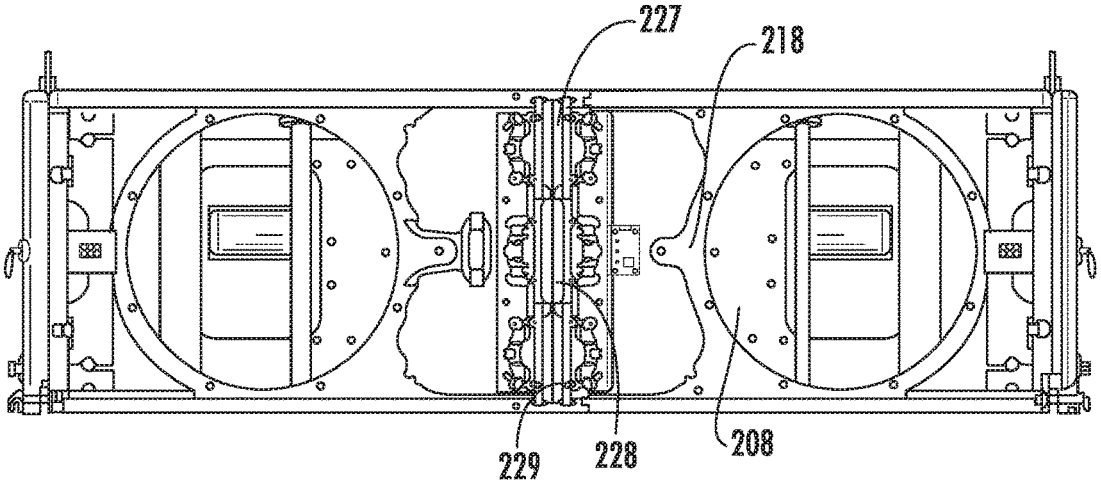
Figure 11:
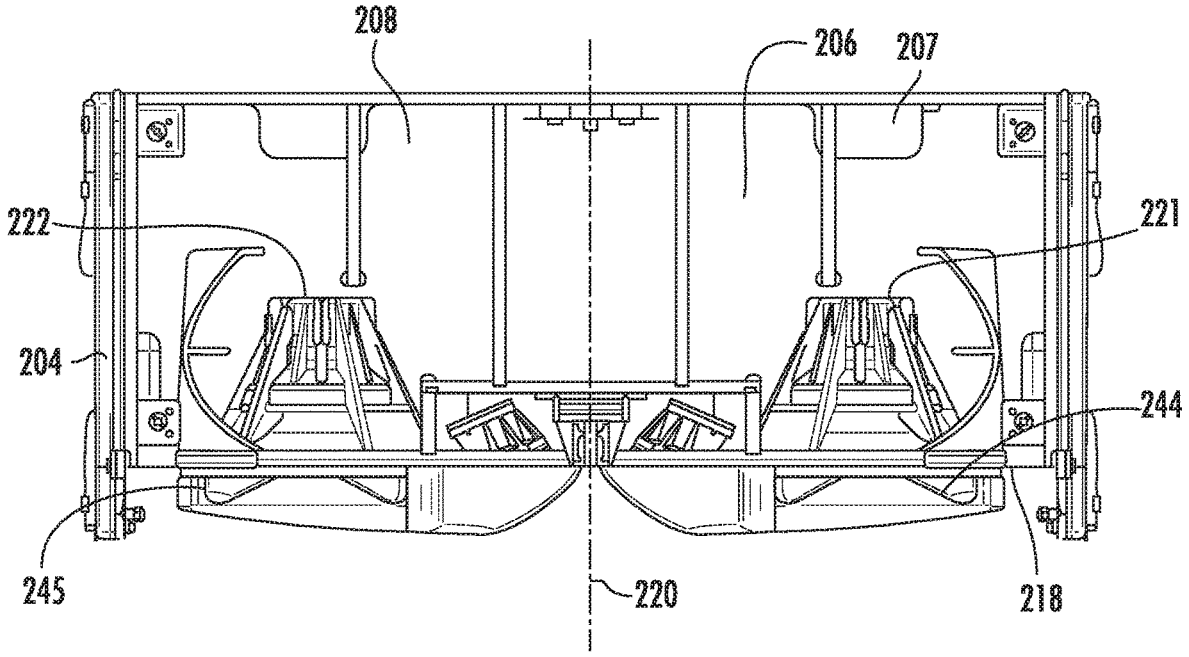
FIG. 11 illustrates a top view of the enclosure of FIGS. 6-10 in a partially assembled state.

As illustrated in FIG. 7, when the first integrator 242 and the first plug 240 are positioned in front of the first low-frequency loudspeaker 209, the first low-frequency loudspeaker includes a first unobstructed area 248 and a second unobstructed area 249. This is because the first integrator 242 and the first plug 240 only cover a portion of the front output side 223 of the first low-frequency loudspeaker 209. Like the first integrator 242 and the first plug 240, when the second integrator 243 and the second plug 241 are positioned in front of the second low-frequency loudspeaker 210, the second low-frequency loudspeaker 210 includes a first unobstructed area 250 and a second unobstructed area 251. This is also because the second integrator 243 and the second plug 241 only cover a portion of the front output side 225 of the second low-frequency loudspeaker 210.

During operation, the acoustic assembly 200 may include a first crossover region and a second crossover region. The first crossover region may be the overlap in frequency ranges between the low-frequency loudspeakers 209, 210 and at least the mid-frequency loudspeakers 211, 212, 213, 214. The second crossover region may be the overlap in frequency ranges between the high-frequency compression drivers 215, 216, 217 and at least the mid-frequency loudspeakers 211, 212, 213, 214.

In the first crossover region, the low-frequency loudspeakers 209, 210 may include sound coverage patterns that may be identical to at least the mid-frequency loudspeakers' 211, 212, 213, 214 sound coverage patterns. For example, in the first crossover region, the first and the second low-frequency loudspeakers 209, 210 may include a first sound coverage angle in the first plane 219 and a second sound coverage angle in the second plane 220. Additionally, in the crossover region, at least the first, the second, the third, and the fourth mid-frequency loudspeakers 211, 212, 213, 214 may include a third sound coverage angle in the first plane 219 and a fourth sound coverage angle in the second plane 220. The first sound coverage angle may be equal to the third sound coverage angle, and the second sound coverage angle may be equal to the fourth sound coverage angle. This may be achieved by the acoustic horn 234 in the acoustic assembly 200.

In the second crossover region, the high-frequency compression drivers 215, 216, 217 may include sound coverage patterns that may be identical to at least the mid-frequency loudspeakers' 211, 212, 213, 214 sound coverage patterns. For example, in the second crossover region, the high-frequency compression drivers 215, 216, 217 may include a first sound coverage angle in the first plane 219 and a second sound coverage angle in the second plane 220. Additionally, in the second crossover region, at least the first, the second, the third, and the fourth mid-frequency loudspeakers 211, 212, 213, 214 may include a third sound coverage angle in the first plane 219 and a fourth sound coverage angle in the second plane 220. The first sound coverage angle may be equal to the third sound coverage angle, and the second sound coverage angle may be equal to the fourth sound coverage angle. This may be achieved by the acoustic horn 234 in the acoustic assembly 200.

Additionally or alternatively, the acoustic assembly 200 may include a third crossover region. The third crossover region may be the overlap in frequency ranges between the low-frequency loudspeakers 209, 210 and the high-frequency compression drivers 215, 216, 217. In the third crossover region, the low-frequency loudspeakers 209, 210 may include sound coverage patterns that may be identical to the high-frequency compression drivers 215, 216, 217. For example, in the third crossover region, the low-frequency loudspeakers 209, 210 may include a first sound coverage angle in the first plane 219 and a second sound coverage angle in the second plane 220. Additionally, in the third crossover region, the high-frequency compression drivers 215, 216, 217 include a third sound coverage angle in the first plane 219 and a fourth sound coverage angle in the second plane 220. The first sound coverage angle may be equal to the third sound coverage angle, and the second sound coverage angle may be equal to the fourth sound coverage angle. This may be achieved by the acoustic horn 234 in the acoustic assembly 200.

Therefore during operation, the acoustic horn 234 in the acoustic assembly 200 may result in a uniform coverage pattern over a listening area in the first plane 219 and/or the second plane 220. The uniform coverage pattern may result in an improved listening experience for persons located in the listening area. That is because the coverage pattern may not differ at various locations inside of the listening area.

As such, and among other things, embodiments herein may improve directivity for acoustic assemblies that include at least one acoustic emitting device and operate over the audible hearing range (20 Hz to 20 KHz).

Figure 12:
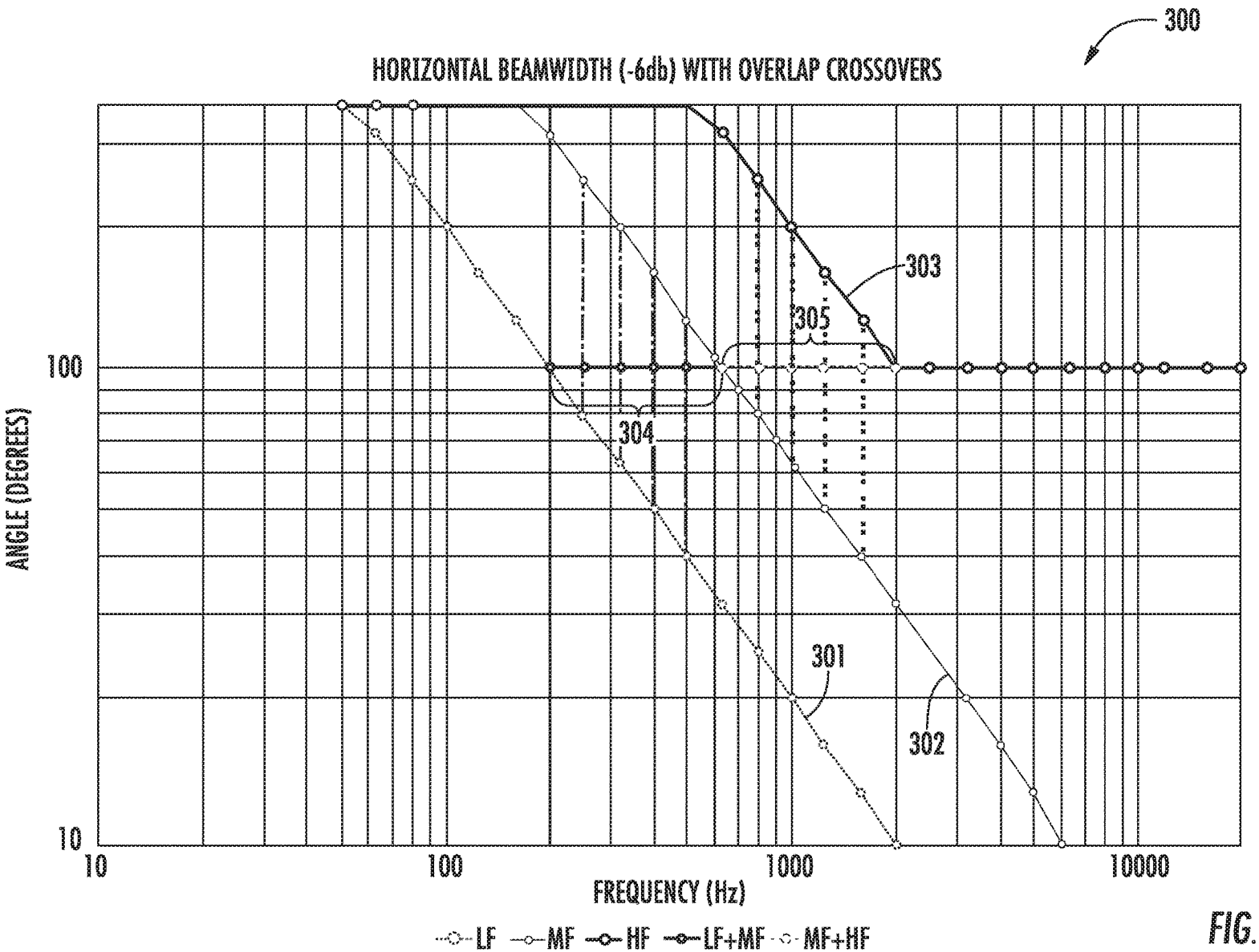
FIG. 12 illustrates a virtual simulation of an acoustic assembly according to one or more embodiments.

FIG. 12 illustrates a virtual-simulation 300 of an acoustic assembly according to one or more embodiments. The virtual-simulation 300 illustrates ideal horizontal beamwidths for the acoustic assembly (i.e., sound coverage angle in a horizontal plane versus frequency). As such, the virtual-simulation 300 illustrates a horizontal beamwidth 301 for at least one low-frequency acoustic emitting device, a horizontal beamwidth 302 for at least one mid-frequency acoustic emitting device, and a horizontal beamwidth 303 for at least one high-frequency acoustic emitting device.

The virtual-simulation 300 further illustrates a first crossover region 304 between the at least one low-frequency acoustic emitting device and the at least one mid-frequency acoustic emitting device. Further, the virtual-simulation illustrates a second crossover region 305 between the at least one mid-frequency acoustic emitting device and the at least one high-frequency acoustic emitting device. In the virtual simulation 300, the first crossover region 304 extends from around 200 Hz to around 600 Hz, and the second crossover region 305 extends from around 600 Hz to 2,000 Hz.

In the virtual-simulation 300, in the first crossover region 304, the at least one low-frequency acoustic emitting device decreases in sound coverage angle as frequency increases. That decrease may be linear. Thus, the decrease in sound coverage angle as frequency increases for the at least one low-frequency acoustic emitting device in the first crossover region 304 may have a constant slope. Similarly, in the first crossover region 304, the at least one mid-frequency acoustic emitting device decreases in sound coverage angle as frequency increases. That decrease may similarly be linear. Thus, the decrease in sound coverage angle as frequency increases for the at least one mid-frequency acoustic emitting device in the first crossover region 304 may have a constant slope. The slope of decrease for the at least one low-frequency acoustic emitting device may be equal to the slope of decrease for the at least one mid-frequency acoustic emitting device. Alternatively, in the first crossover region 304, the curve of decrease for the at least one low-frequency acoustic emitting device may be parallel to the curve of decrease for the at least one mid-frequency acoustic emitting device. The equal slope and/or parallel curves may be a byproduct of the acoustic horn in the acoustic assembly. This may be due to the interaction between the at least one low-frequency acoustic emitting device, the at least one mid-frequency acoustic emitting device, the at least one high-frequency acoustic emitting device, and the acoustic horn in the acoustic assembly.

In the virtual simulation 300, in the first crossover region 304, the sound coverage angle for the at least one mid-frequency acoustic emitting device may be greater than the sound coverage angle for the at least one low-frequency acoustic emitting device at a given frequency. The net result, however, may yield a constant coverage angle. For example, as the virtual-simulation 300 illustrates, in the first crossover region 304, the net result yields or substantially yields a sound coverage angle of 100 degrees. The net result may be a byproduct of the acoustic horn in the acoustic assembly. This may be due to the interaction between the at least one low-frequency acoustic emitting device, the at least one mid-frequency acoustic emitting device, and the acoustic horn in the acoustic assembly.

In the virtual-simulation 300, in the second crossover region 305, the at least one mid-frequency acoustic emitting device decreases in sound coverage angle as frequency increases. That decrease may be linear. Thus, the decrease in sound coverage angle as frequency increases for the at least one mid-frequency acoustic emitting device in the second crossover region 305 may have a constant slope. Similarly, in the second crossover region 305, the at least one high-frequency acoustic emitting device decreases in sound coverage angle as frequency increases. That decrease may similarly be linear. Thus, the decrease in sound coverage angle as frequency increases for the at least one high-frequency acoustic emitting device in the second crossover region 305 may have a constant slope. The slope of decrease for the at least one mid-frequency acoustic emitting device may be equal to the slope of decrease for the at least one high-frequency acoustic emitting device. Alternatively, in the first crossover region 304, the curve of decrease for the at least one mid-frequency acoustic emitting device may be parallel or substantially parallel to the curve of decrease for the at least one high-frequency acoustic emitting device.

In the virtual simulation 300, in the second crossover region 305, the sound coverage angle for the at least one mid-frequency acoustic emitting device may be less than the sound coverage angle for the at least one high-frequency acoustic emitting device at a given frequency. The net result, however, may yield a constant coverage angle. For example, as the virtual-simulation 300 illustrates, in the second crossover region 305, the net result yields or substantially yields a sound coverage angle of 100 degrees. The net result may be a byproduct of the acoustic horn in the acoustic assembly. This may be due to the interaction between the at least one mid-frequency acoustic emitting device, the at least one high-frequency acoustic emitting device, and the acoustic horn in the acoustic assembly.

Thus the acoustic horn in the acoustic assembly improves the beamwidths in a given plane, such as the horizontal plane or vertical plane. This improvement may be particularly evident in the crossover regions of the acoustic assembly. In the crossover regions, the acoustic horn may achieve desirable beamwidths.

Figure 13:
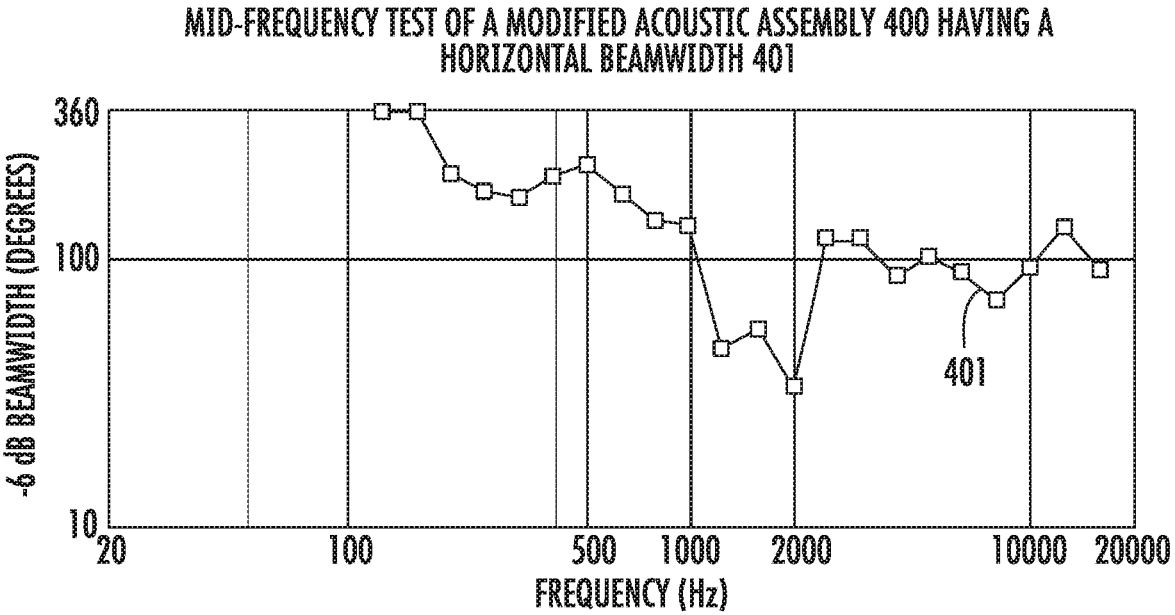
FIG. 13 illustrates results of a mid-frequency test of a modified acoustic assembly, which is at least in part based on one or more embodiments.

FIG. 13 illustrates results of a mid-frequency test of a modified acoustic assembly 400, which is primarily based on the acoustic assembly 200 of FIGS. 6-11. Unlike the acoustic assembly 200, though, the modified acoustic assembly 400 does not include a first plug or a second plug, nor does the modified acoustic assembly 400 include a first integrator that extends over a first low-frequency loudspeaker or a second integrator that extends over a second low-frequency loudspeaker. Instead, the first and the second integrators in the modified acoustic assembly 400 stop short of the first and the second low-frequency loudspeakers. Besides that, though, the modified acoustic assembly is based on the acoustic assembly 200 of FIGS. 6-11. The mid-frequency test of the modified acoustic assembly 400 illustrates a horizontal beamwidth 401.

Figure 14:
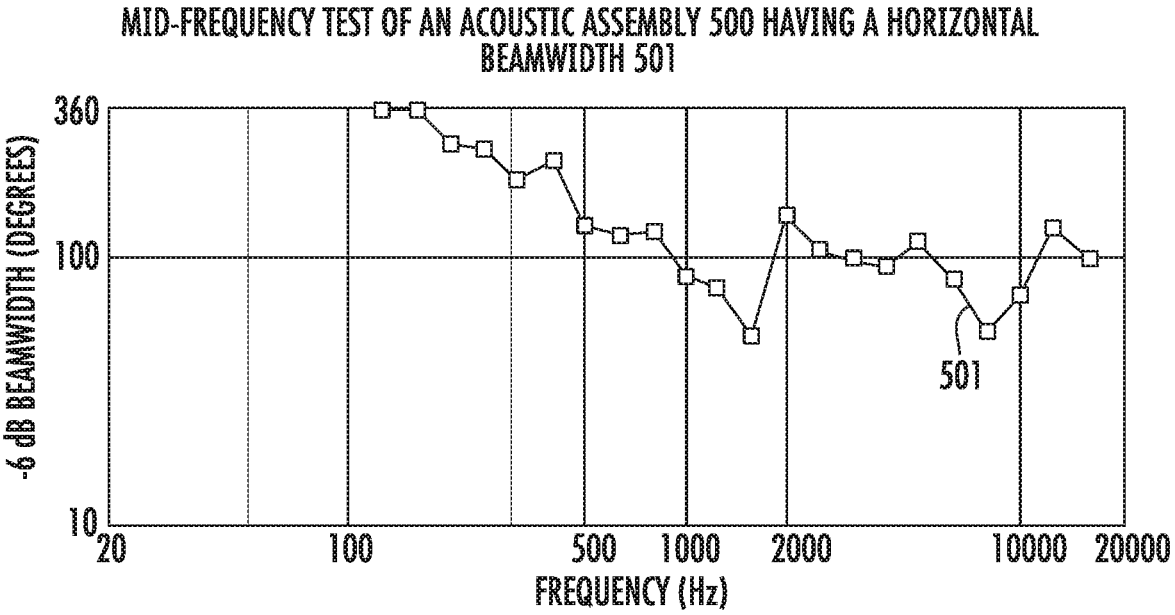
FIG. 14 illustrates results of a mid-frequency test of an acoustic assembly according to one or more embodiments.

FIG. 14 illustrates results of a mid-frequency test of an acoustic assembly 500, which is based on the acoustic assembly 200 of FIGS. 6-11. Unlike the modified acoustic assembly 400, the acoustic assembly 500 does include a first plug and a second plug, which are positioned in front of a first and a second low-frequency loudspeaker, like in the acoustic assembly 200. Moreover, unlike the modified acoustic assembly 400, the acoustic assembly 500 includes a first integrator and a second integrator that does extend over portions of the first and the second low-frequency loudspeakers, like in the acoustic assembly 200. With the exceptions regarding the first plug, the second plug, the first integrator, and the second integrator, the modified acoustic assembly 400 and the acoustic assembly 500 are identical. The mid-frequency test of the acoustic assembly 500 illustrates a horizontal beamwidth 501.

Comparing FIG. 13 to FIG. 14 reveals that in a first critical passband between 500 Hz to 1,000 Hz, the horizontal beamwidth 401 of the modified acoustic assembly 400 is generally much wider than the horizontal beamwidth 501 of the acoustic assembly 500. Additionally, in a second critical passband between 1,000 Hz and 2,000 Hz, the horizontal beamwidth 401 of the modified acoustic assembly 400 becomes much narrower than the horizontal beamwidth 501 of the acoustic assembly 500. For the first critical passband and the second critical passband, when a target horizontal beamwidth of 90 degrees is set, based on the tests in FIGS. 16-17, the acoustic assembly 500 outperforms the modified acoustic assembly 400. This is because the horizontal beamwidth 501 of the acoustic assembly 500 is closer to the target horizontal beamwidth than the horizontal beamwidth 401 of the modified acoustic assembly 400.

Moreover, the acoustic assembly 500 outperforms the modified acoustic assembly 400 because the horizontal beamwidth 501 of the acoustic assembly 500 includes a nearly linear decrease in sound coverage angle over frequency between around 100 Hz to around 2,000 Hz. Conversely, the modified acoustic assembly 400 yields a significantly non-linear curve over that range. The nearly linear decrease for the horizontal beamwidth 501 of the acoustic assembly 500 is preferable than the significantly non-linear curve for the horizontal beamwidth of the modified acoustic assembly 400. The nearly linear decrease for the horizontal beamwidth 501 of the acoustic assembly 500 is closer to the corresponding ideal beamwidth 302 that is depicted in the virtual-simulation 300 than the significantly non-linear curve for the horizontal beamwidth 401 of the modified acoustic assembly 400.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An acoustic assembly comprising:

an enclosure;

a first transducer attached to the enclosure and configured to emit sound along a first path over a first frequency range;

a second transducer attached to the enclosure and configured to emit sound along a second path over a second frequency range; and an acoustic horn attached to the enclosure and positioned to at least partially extend into the first path and the second path for adjusting at least one beamwidth in a crossover region of the first frequency range and the second frequency range, wherein the acoustic horn includes:

a waveguide positioned to at least partially extend into the first path; and an integrator attached to the waveguide and positioned to at least partially extend into the second path.

2. The acoustic assembly of claim 1, further comprising a third transducer attached to the enclosure and configured to emit sound along a third path over a third frequency range.

3. The acoustic assembly of claim 2, wherein the acoustic horn is positioned to at least partially extend into the third path for adjusting at least one beamwidth in a crossover region of the second frequency range and the third frequency range.

4. The acoustic assembly of claim 3, wherein the integrator is positioned to at least partially extend into the third path.

5. The acoustic assembly of claim 4, wherein the integrator includes a lens positioned to at least partially extend into the second path.

6. The acoustic assembly of claim 5, wherein the integrator includes a plug positioned to at least partially extend into the third path.

7. An acoustic assembly comprising:

an enclosure;

a plurality of transducers supported by the enclosure, the plurality including:

a first transducer for emitting sound along a first path over a first frequency range; and a second transducer for emitting sound along a second path over a second frequency range; and an acoustic horn attached to the enclosure and positioned to extend at least partially into the first path of the first transducer and the second path of the second transducer to adjust at least one beamwidth in a crossover region of the first frequency range and the second frequency range, wherein the acoustic horn is aligned along a first plane that bisects the enclosure and a second plane that is arranged perpendicular to the first plane, and wherein the acoustic horn includes:

a waveguide aligned along the second plane;

a first integrator aligned along the first plane; and a second integrator aligned along and spaced from the first integrator on the first plane.

8. The acoustic assembly of claim 7, further comprising a third transducer attached to the enclosure and configured to emit sound along a third path over a third frequency range.

9. The acoustic assembly of claim 8, wherein the acoustic horn is positioned to at least partially extend into the third path of the third transducer for adjusting at least one beamwidth in a crossover region of the second frequency range and the third frequency range.

10. The acoustic assembly of claim 7, wherein the first integrator includes a plug aligned along the first plane and a lens offset from the first plane and the second plane, and the second integrator includes a plug aligned along the first plane and a lens offset from the first plane and the second plane.

11. The acoustic assembly of claim 10, wherein the lens of the first integrator includes a first lens and a second lens, and the lens of the second integrator includes a third lens and a fourth lens, wherein the first lens, the second lens, the third lens, and the fourth lens are evenly distributed around the first plane and the second plane.

12. The acoustic assembly of claim 10, wherein the plug of the first integrator forms a first sealed chamber with the first integrator, and the plug of the second integrator forms a second sealed chamber with the second integrator.

13. The acoustic assembly of claim 7, wherein the second plane evenly bisects a first portion of the acoustic horn from a second portion of the acoustic horn, wherein the first portion mirrors the second portion.

14. An acoustic assembly comprising:

an enclosure;

a first plurality of transducers attached to the enclosure and configured to emit sound over a first frequency range;

a second plurality of transducers attached to the enclosure and configured to emit sound over a second frequency range;

a third plurality of transducers attached to the enclosure and configured to emit sound over a third frequency range; and an acoustic horn positioned on the enclosure for adjusting at least one beamwidth in a crossover region of the first frequency range and the second frequency range and for adjusting at least one beamwidth in a crossover region of the second frequency range and the third frequency range, the acoustic horn including:

a waveguide;

a first integrator attached to the waveguide; and a second integrator attached to the waveguide and spaced from the first integrator.

15. The acoustic assembly of claim 14, wherein the acoustic horn is aligned along a first plane and a second plane that is perpendicular to the first plane, wherein the waveguide is aligned along the second plane, and the first integrator and the second integrator are aligned along the first plane.

16. The acoustic assembly of claim 15, wherein the first integrator includes a first plug aligned along the first plane and a first plurality of lenses offset from the first plane and the second plane, wherein the second integrator includes a second plug aligned along the first plane and a second plurality of lenses offset from the first plane and the second plane.

17. The acoustic assembly of claim 16, wherein the first plurality of transducers includes at least three transducers aligned along the second plane, each transducer in the first plurality of transducers is configured to include a sound path for emitting sound over the first frequency range, wherein the waveguide is positioned to at least partially extend into each of the sound paths of the at least three transducers of the first plurality of transducers.

18. The acoustic assembly of claim 17, wherein the first plurality of lenses includes a first lens and a second lens, and the second plurality of lenses includes a third lens and a fourth lens, wherein the second plurality of transducers includes a first transducer, a second transducer, a third transducer, and a fourth transducer, each transducer in the second plurality of transducers is configured to include a sound path for emitting sound over the second frequency range, wherein the first lens is positioned to at least partially extend into the sound path of the first transducer, the second lens is positioned to at least partially extend into the sound path of the second transducer, the third lens is positioned to at least partially extend into the sound path of the third transducer, and the fourth lens is positioned to at least partially extend into the sound path of the fourth transducer.

19. The acoustic assembly of claim 18, wherein the first integrator includes a first aperture and a second aperture, wherein the first lens is aligned with the first aperture to further fluid communication for sound from the first transducer of the second plurality of transducers, and the second lens is aligned with the second aperture to further fluid communication for sound from the second transducer of the second plurality of transducers, wherein the second integrator includes a third aperture and a fourth aperture, wherein the third lens is aligned with the third aperture to further fluid communication for sound from the third transducer of the second plurality of transducers, and the fourth lens is aligned with the fourth aperture to further fluid communication for sound from the fourth transducer of the second plurality of transducers.

20. The acoustic assembly of claim 18, wherein the third plurality of transducers includes a first transducer and a second transducer, each transducer in the third plurality of transducers is configured to include a sound path for emitting sound over the third frequency range, wherein the first plug is positioned to at least partially extend into the sound path of the first transducer of the third plurality of transducers, and the second plug is positioned to at least partially extend into the sound path of the second transducer of the third plurality of transducers.

* * * * *